United States Patent [19]

Zeman

[11] 4,344,698

[45] Aug. 17, 1982

[54] ELECTROPHOTOGRAPHIC APPARATUS HAVING IMPROVED GROUNDING MEANS

[75] Inventor: Robert E. Zeman, Webster, N.Y.

[73] Assignee: Eastman Kodak Company, Rochester, N.Y.

[21] Appl. No.: 192,769

[22] Filed: Oct. 1, 1980

[51] Int. Cl.[3] ..... G03G 15/00

[52] U.S. Cl. ..... 355/16; 83/425; 83/881; 355/13

[58] Field of Search ..... 355/3 R, 3 BE, 16, 13; 83/56, 425, 881, 879, 886

[56] References Cited

U.S. PATENT DOCUMENTS

| | | | |
|---|---|---|---|
| 3,533,692 | 10/1970 | Blanchette et al. | 355/16 |
| 3,543,023 | 11/1970 | Yellin et al. | 250/49.5 |
| 3,552,957 | 1/1971 | Hodges | 95/1.5 |
| 3,574,615 | 4/1971 | Morse | 96/1.5 |
| 3,620,614 | 11/1971 | Gunto et al. | 355/3 BE |
| 3,639,121 | 2/1972 | York | 96/1.5 |
| 3,684,503 | 8/1972 | Humphriss et al. | 96/1.5 |
| 3,743,410 | 7/1973 | Edelman et al. | 355/16 X |
| 3,783,021 | 1/1974 | York | 117/212 |
| 3,796,488 | 3/1974 | Tanaka et al. | 355/16 |
| 3,910,475 | 10/1975 | Pundsak et al. | 226/6 |
| 3,937,960 | 2/1976 | Matsumoto et al. | 250/326 |

FOREIGN PATENT DOCUMENTS

| | | |
|---|---|---|
| 1249734 | 10/1971 | United Kingdom . |
| 1490001 | 10/1977 | United Kingdom . |
| 1490002 | 10/1977 | United Kingdom . |
| 1496500 | 12/1977 | United Kingdom . |

OTHER PUBLICATIONS

Research Disclosure #18443, vol. 184, Aug., 1979–published by Industrial Opportunities Ltd., Homewell, Havant, Hampshire, P09 1EF, UK.

Research Disclosure #17529, vol. 175, Nov. 1978 pub. by Industrial Opportunities Ltd., Homewell, Havant, Hampshire, P09 1EF, UK.

*Research Disclosure,* No. 17529, p. 47–50, Nov. 1978 and No. 18443, pp. 455,456, Aug. 79.

*Primary Examiner*—Richard L. Moses

*Attorney, Agent, or Firm*—John D. Husser

[57] ABSTRACT

Electrophotographic apparatus of the kind utilizing a flexible photoconductor film or web including a support and photoconductive layer sandwiching a conducting layer comprises a grounding member having an incising edge. The grounding member is electrically coupled to a reference potential and urged into a predetermined cutting position to incise the photoconductive layer and to effect contact of the conductive layer as film is moved therepast along the operative path of the apparatus.

10 Claims, 5 Drawing Figures

ELECTROPHOTOGRAPHIC APPARATUS HAVING IMPROVED GROUNDING MEANS

BACKGROUND OF THE INVENTION

1. Field of the Invention

The present invention relates to electrophotographic apparatus and more particularly to such apparatus having improved means for coupling the conductive layer of photoconductive films or webs to a reference potential.

2. Description of the Prior Art

In electrophotography the use of photoconductive imaging elements in the form of films or webs has become increasingly popular, both in applications where the imaging element is intended for repeated use and in applications where the element is intended for a single use. Such elements usually comprise a photoconductor layer overlying a conductive layer on a support, e.g., a plastic film; and in most imaging procedures it is desired that the conductive layer, which is sandwiched between the other element layers, be coupled to a source of reference potential, usually ground potential.

A wide variety of techniques have been employed to provide such an electrical reference potential to the element's conductive layer (which procedure will hereinafter be referred to generally as "grounding"). In one approach special edge constructions, e.g., perforations, inbibed conductive coatings and abraded outer layer portions, have been formed to cooperate with specially designed contacting mechanisms in the electrophotographic apparatus. In other approaches sophisticated systems such as opposing corona chargers or molten alloy or mercury contact baths have been utilized.

Each of the above approaches is effective in a controlled environment; however, some suffer in reliability when not carefully controlled, and all involve fairly substantial additional cost increments to the imaging system. This additional cost is not so significant in more sophisticated apparatus which use the imaging element repeatedly; however, for less complex apparatus of the type in which the element has a single use, the cost is a significant disadvantage. Apparatus of this latter type often use supplies of the image element in roll form, and a common technique for grounding the film or webs is via the core on which they are wound. That is, the end portion of the roll is designed, in some fashion, to have electrical contact with the core and the core is grounded. Besides requiring special fabrication procedures, this approach also can produce potential differentials in the conductive layer, due to the long path (of the connection to the outer winds of the roll) and the significant resistance of the conducting layers.

SUMMARY OF THE INVENTION

It is therefore one purpose of the present invention to provide an improved approach for grounding, or connecting to a reference potential, such as photoconductive image elements. This approach involves no special fabrication for the film and the apparatus for effecting the grounding is simple and reliable. In general, the device for effecting such improved grounding comprises electrically-conductive means for predeterminedly incising along an edge portion of the imaging element and into the conductive layer of such element. The electrically-conductive means is in turn coupled to ground by suitable connecting means, and such connection remarkably maintains the conducting layer at ground potential with a high degree of consistency throughout usage of entire rolls of such film.

BRIEF DESCRIPTION OF THE DRAWINGS

The subsequent description of preferred embodiments of the present invention is made with reference to the attached drawings in which.

DETAILED DESCRIPTION OF THE PREFERRED EMBODIMENTS

Figure 1:
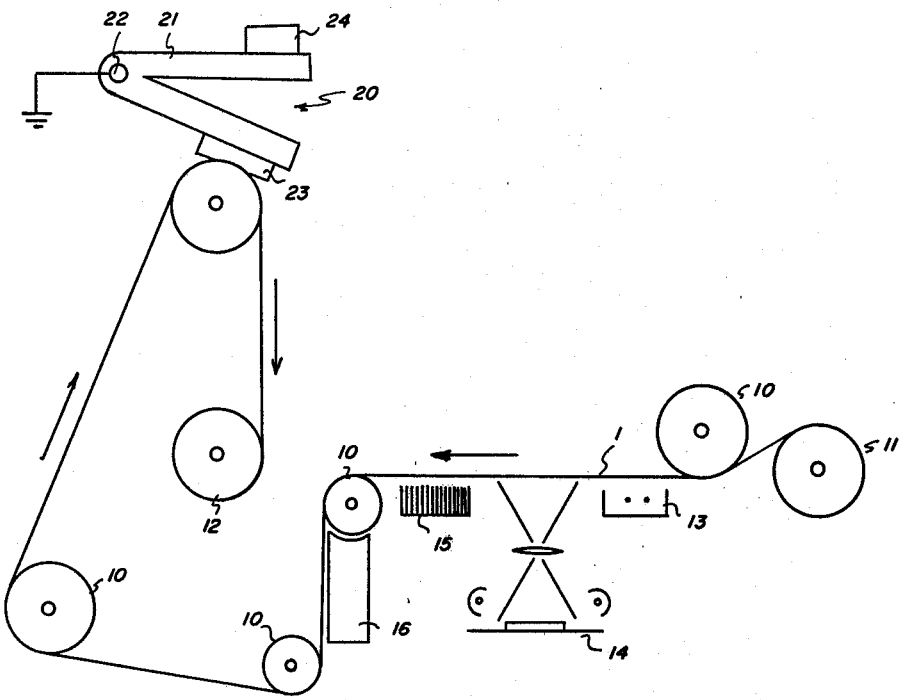
FIG. 1 is a schematic side view illustrating an embodiment of the present invention.

The embodiment shown in FIG. 1 is typical of electrophotographic apparatus of the kind in which improved grounding means in accord with the present invention can be advantageously employed. The apparatus comprises a plurality of feed and/or guide roller 10 that define an operative path along which a photoconductor film or web 1 is transported from a supply roll 11 to a take-up roll 12 for electrophotographic imaging. Located along the operative path are a conventional corona charging station 13, an exposure station 14, a development station 15 and a drying and/or fusing station 16. These stations can be configured in various forms and there are known alternative devices for accomplishing each of the electrophotographic procedures schematically illustrated. In general such apparatus will provide a uniform electrostatic charge on the photoconductor, followed by imagewise discharge of the photoconductor by light image exposure to form a latent electrostatic image which is then rendered visible by the application of toner to the charge pattern. Thereafter the toner image is fixed to the photoconductor by drying or fusing.

Figure 3:
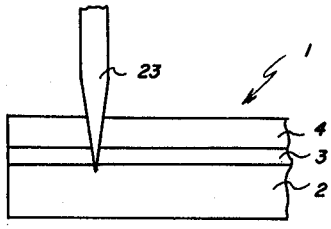
FIG. 3 is a schematic view of a film and grounding means such as shown in FIG. 2 but from a direction orthogonal to that of FIG. 2.

As shown more clearly in FIG. 3, the photoconductor film comprises a support 2, formed e.g., of a durable plastic such as poly(ethylene terephthalate), a conductive layer 3, formed e.g. of conducting cuprous iodide and a photoconductive insulator layer 4, formed e.g. of an organic photoconductor. As is well known in the art of electrophotography, it is necessary that the conductive layer 3 of the photoconductor 1 be effectively connected to a reference potential, e.g., ground.

Figure 2:
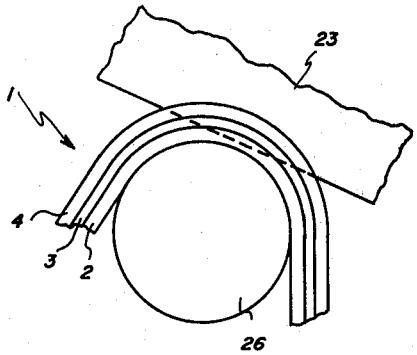
FIG. 2 is an enlarged schematic view of a portion of the apparatus shown in FIG. 1.

One embodiment for accomplishing such grounding in accordance with the present invention is shown in FIGS. 1–3 and designated generally by the numeral 20.

The grounding means 20 comprises a grounding arm 21 which is mounted on a pivot 22 of the apparatus housing. As shown, the pivot electrically connects grounding arm 21 to a reference potential, e.g., ground. Attached to the other end of arm 21 is incising means 23 having a lower edge that is keenly sharp and aligned parallel to an edge of the film path. The arm 21 is weighted, e.g., with a weight 24 that is adjustable along the length of the arm so as to enable a predetermined force urging the incising means into film moving along the operative path of the apparatus. Desirably a compliant roller 26 is located opposite incising means 20 and, as shown more clearly in FIGS. 2 and 3, the gravitational force of arm 21 is selected so as to cause the sharp edge of the incising means to sever the photoconductive layer 4 and the conducting layer 3 but not to completely slit the support 2. As shown in FIG. 2, it is desirable that the sharp edge form a chord subtending an angle of the conductive layer 3 thus making continuous electrical contact with the conductive layer. It also is preferred that the pivot 22 of arm 21 be upstream of the zone of engagement between the incising means 23 and film 1 so that the sharp edge tracks smoothly in the film 1 without periodically skipping upwardly. Thus, in operation the knife edge provides a highly effective yet simple means of coupling successive sections of the conductive layer to ground as the film 1 is advanced along the operative electrophotographic path.

Figure 4:
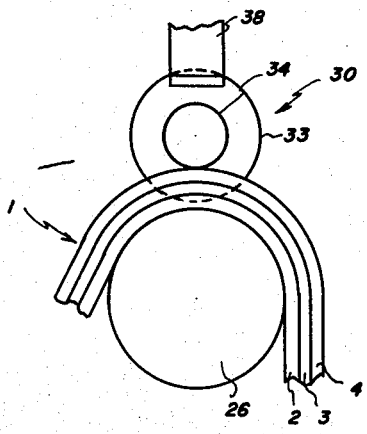
FIG. 4 is a schematic side view of an alternative embodiment of the present invention.
Figure 5:
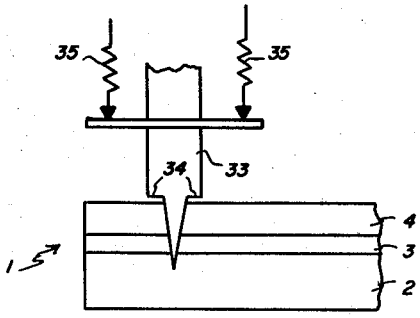
FIG. 5 is a schematic view of the FIG. 4 grounding means from a direction orthogonal to that of FIG. 4.

FIGS. 4 and 5 disclose another preferred embodiment of the present invention denoted generally 30. In this embodiment the incising means 33 is configured as a disc having a razor-like peripheral edge portion and annular flanges 34. The disc-shaped means 33 is mounted for rotation on a shaft 34 which is biased by suitable spring means 35 toward the compliant roller 26. It is preferred that the shaft coupling provide sufficient friction, or be driven, to provide relative movement between the disc means 33 and the film 1. It will be appreciated that the embodiment shown in FIGS. 4 and 5 provide a positive means of maintaining a predetermined depth to the incision of the film 1. In certain applications it can be desirable to provide sharpening means 38 to continuously hone the edge of disc 33 at a location spaced from the film 1.

The invention has been described in detail with particular reference to certain preferred embodiments thereof, but it will be understood that variations and modifications can be effected within the spirit and scope of the invention.

What is claimed is:

1. In electrophotographic apparatus of the type having means for feeding an imaging element, including an incisable photoconductive layer overlying a conductive layer on an insulative support, along an operative path for charging, exposure and development, an improved device for electrically coupling the conductive layer of such element to a reference potential, said device being particularly suitable for single-use, web or film type imaging elements and comprising:

(a) electrically-conductive means located along said path for incising, along an edge portion of the imaging element fed thereby, into the conductive layer of such element; and (b) means for electrically connecting said electrically-conductive means to such reference potential.

2. The invention defined in claim 1 wherein said electrically-conductive means is mounted for movement toward and away from said path and includes means for urging it toward said path with a predetermined force.

3. The invention defined in claim 2 further including a compliant means, located across said path from said electrically-conductive means, for supporting the imaging element during its incision.

4. The invention defined in claim 2 wherein said electrically-conductive means is pivotally mounted at a location upstream from the zone of incision.

5. The invention defined in claim 4 wherein said electrically-conductive means is located above said path and said urging means comprises the weight of said electrically-conductive means.

6. The invention defined in claim 1 wherein said electrically-conductive means has a razor-like edge.

7. The invention defined in claim 1 wherein said electrically-conductive means comprises an incising edge and means for controlling the depth of incision by said edge into the image element.

8. The invention defined in claim 7 wherein said controlling means comprises flanges on said edge.

9. The invention defined in claim 1 further including means for sharpening said electrically-conductive means.

10. The invention defined in claim 1 wherein said electrically-conductive means comprises a generally circular blade adapted for rotation to provide a relative velocity difference with incised film and means, contacting the periphery of said blade at a location spaced from said path, for sharpening said blade.

* * * * *